US006733024B1

(12) United States Patent
Savegnago

(10) Patent No.: US 6,733,024 B1
(45) Date of Patent: May 11, 2004

(54) COMMODE CONVERTIBLE WHEELCHAIR APPARATUS

(76) Inventor: Egidio Savegnago, 3815 Haslam Rd., Port Albernie, British Columbia (CA), V9Y 6A3

( * ) Notice: Subject to any disclaimer, the term of this patent is extended or adjusted under 35 U.S.C. 154(b) by 0 days.

(21) Appl. No.: 10/282,315

(22) Filed: Oct. 29, 2002

(51) Int. Cl.[7] ..... B62M 1/14; A61G 7/02
(52) U.S. Cl. ..... 280/250.1; 4/480
(58) Field of Search ..... 280/250.1, 304.1; 4/480

(56) References Cited

U.S. PATENT DOCUMENTS 2,086,550 A * 7/1937 Hartig ..... 4/480
3,061,368 A * 10/1962 Matthews ..... 297/118
3,271,785 A * 9/1966 DuBose ..... 4/480
4,229,039 A * 10/1980 Day ..... 297/232
4,510,631 A * 4/1985 Grady ..... 4/478
5,285,535 A * 2/1994 Stewart et al. ..... 4/480
5,564,136 A * 10/1996 Cox ..... 4/480
2001/0010099 A1 * 8/2001 Shero ..... 4/480
2002/0024196 A1 * 2/2002 Malassigne et al. ..... 280/648

FOREIGN PATENT DOCUMENTS

WO 85/01866 * 5/1985

* cited by examiner

*Primary Examiner*—Kevin Hurley

(57) ABSTRACT

A commode convertible wheelchair apparatus for converting a wheelchair into a commode for use by a physically-challenged user. The commode convertible wheelchair apparatus includes a frame assembly including elongate seat support members and elongate backrest support members, and also including leg members being attached to the elongate seat support members and to the elongate backrest support members; and also includes a wheel assembly being mounted to the leg members; and further includes handle members being attached to the elongate backrest support members; and further includes a seat cushion assembly being disposed upon the elongate seat support members; and also includes a backrest member being supported by the backrest support members; and further includes a commode assembly including a receptacle being removably supported by the seat assembly.

8 Claims, 3 Drawing Sheets

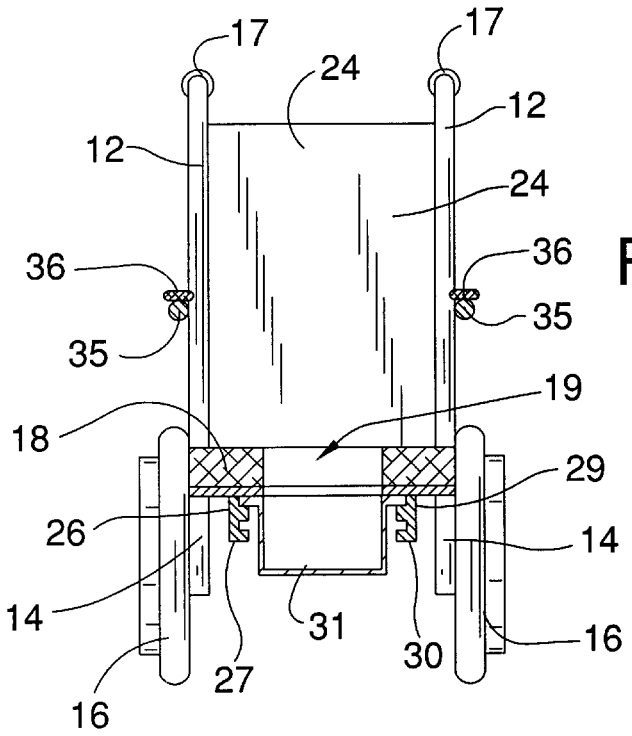
FIG. 3
FIG. 4
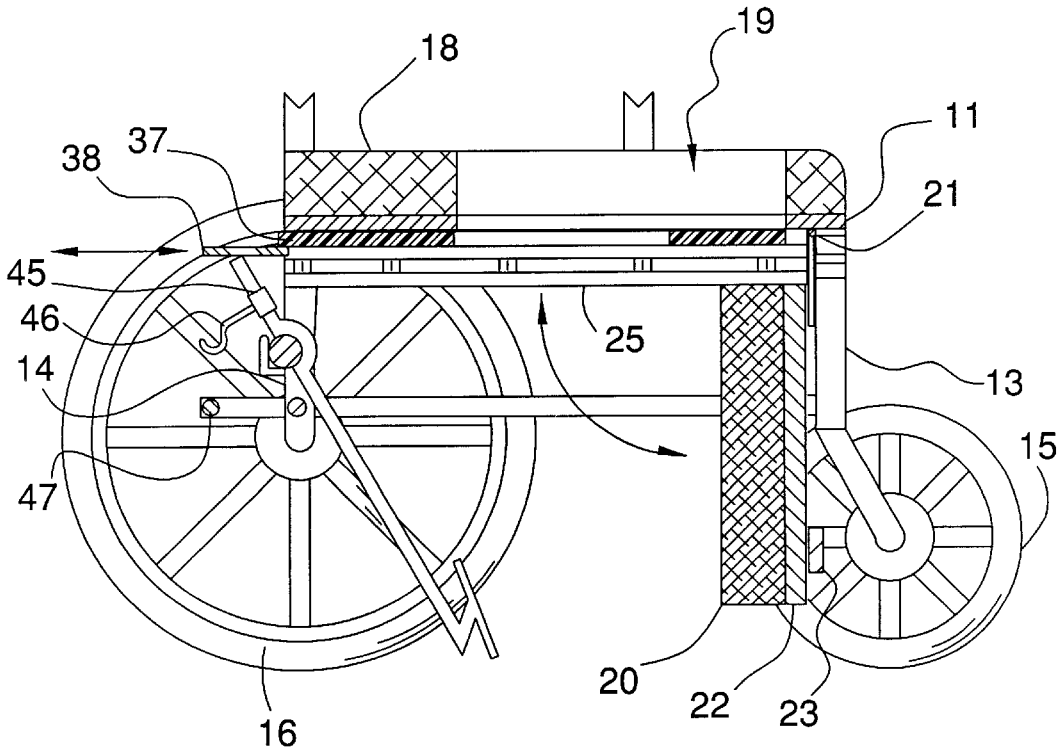

COMMODE CONVERTIBLE WHEELCHAIR APPARATUS

BACKGROUND OF THE INVENTION

1. Field of the Invention

The present invention relates to convertible commode wheelchairs and more particularly pertains to a new commode convertible wheelchair apparatus for converting a wheelchair into a commode for use by a physically-challenged user.

2. Description of the Prior Art

The use of convertible commode wheelchairs is known in the prior art. More specifically, convertible commode wheelchairs heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,880,783; U.S. Pat. No. 3,061,368; U.S. Pat. No. 5,577,753; U.S. Pat. No. 5,285,535; U.S. Pat. No. 4,949,408; and U.S. Pat. No. Des. 439,869.

While these devices fulfill their respective, particular objectives and requirements, the aforementioned patents do not disclose a new commode convertible wheelchair apparatus. The prior art includes wheelchairs having commodes built into them.

SUMMARY OF THE INVENTION

The general purpose of the present invention, which will be described subsequently in greater detail, is to provide a new commode convertible wheelchair apparatus which has many of the advantages of the convertible commode wheelchairs mentioned heretofore and many novel features that result in a new commode convertible wheelchair apparatus which is not anticipated, rendered obvious, suggested, or even implied by any of the prior art convertible commode wheelchairs, either alone or in any combination thereof. The present invention includes a frame assembly including elongate seat support members and elongate backrest support members, and also including leg members being attached to the elongate seat support members and to the elongate backrest support members; and also includes a wheel assembly being mounted to the leg members; and further includes handle members being attached to the elongate backrest support members; and further includes a seat cushion assembly being disposed upon the elongate seat support members; and also includes a backrest member being supported by the backrest support members; and further includes a commode assembly including a receptacle being removably supported by the seat assembly. None of the prior art includes the commode assembly or the seat assembly of the present invention.

There has thus been outlined, rather broadly, the more important features of the commode convertible wheelchair apparatus in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new commode convertible wheelchair apparatus which has many of the advantages of the convertible commode wheelchairs mentioned heretofore and many novel features that result in a new commode convertible wheelchair apparatus which is not anticipated, rendered obvious, suggested, or even implied by any of the prior art convertible commode wheelchairs, either alone or in any combination thereof.

Still another object of the present invention is to provide a new commode convertible wheelchair apparatus for converting a wheelchair into a commode for use by a physically-challenged user.

Still yet another object of the present invention is to provide a new commode convertible wheelchair apparatus that is easy and convenient to use.

Even still another object of the present invention is to provide a new commode convertible wheelchair apparatus that eliminates having to transfer the user from one chair to another, and also allows the user to remain seated upon one's wheelchair, and further reduces harm to the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a rear elevational view of the present invention.

FIG. 4 is a partial cross-sectional view of the present invention.

DESCRIPTION OF THE PREFERRED EMBODIMENT

Figure 1:
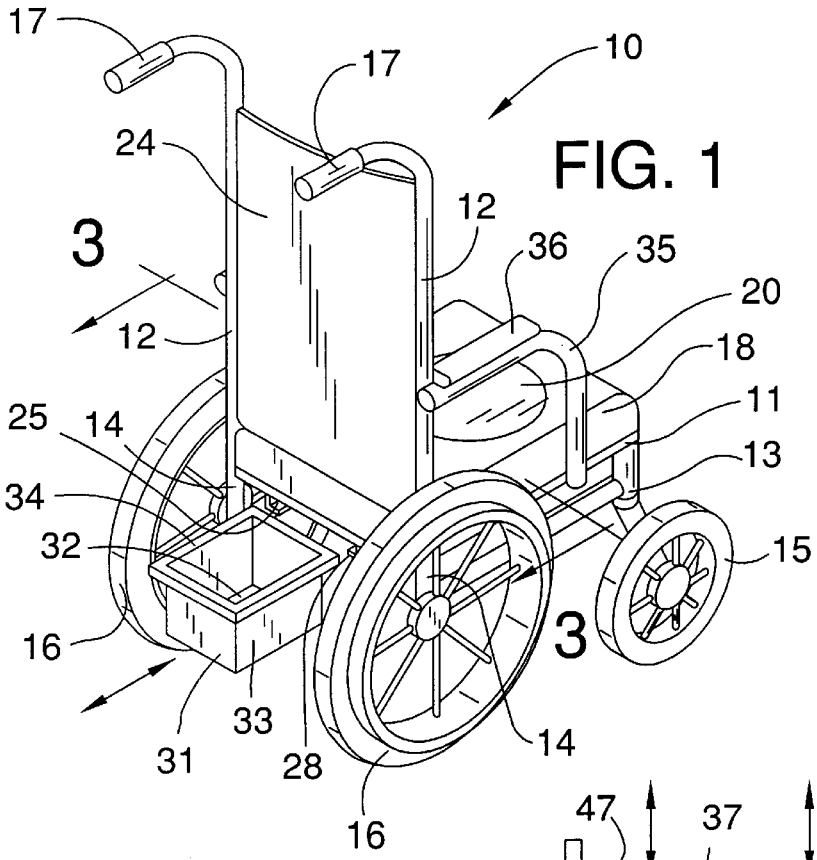
FIG. 1 is a perspective view of a new commode convertible wheelchair apparatus according to the present invention.
Figure 2:
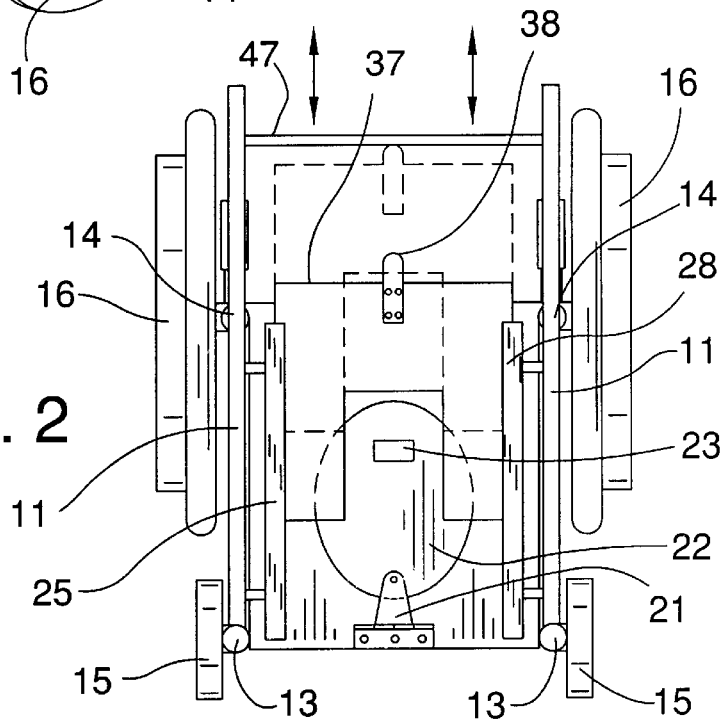
FIG. 2 is a bottom plan view of the present invention.
Figure 5:
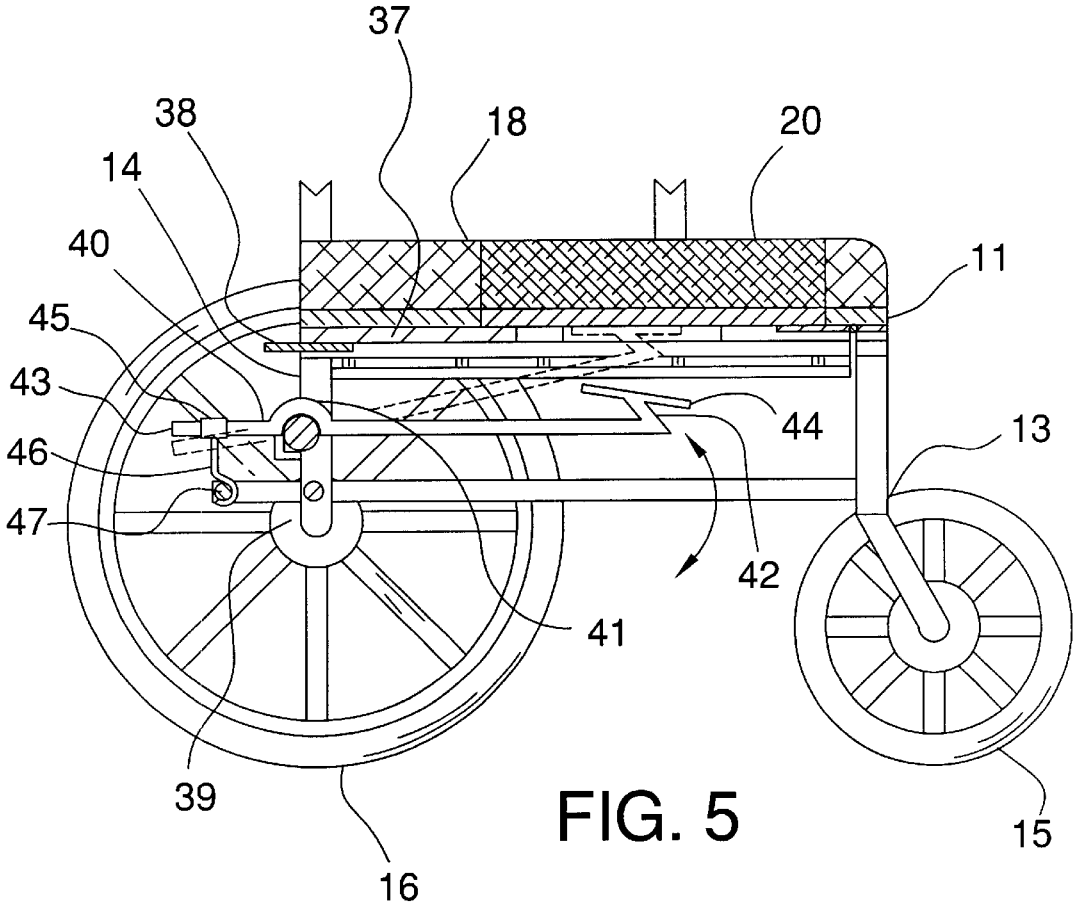
FIG. 5 is a partial cross-sectional view of another embodiment of the present invention.

With reference now to the drawings, and in particular to FIGS. 1 through 5 thereof, a new commode convertible wheelchair apparatus embodying the principles and concepts of the present invention and generally designated by the reference numeral 10 will be described.

As best illustrated in FIGS. 1 through 5, the commode convertible wheelchair apparatus 10 generally comprises a frame assembly including elongate seat support members 11 and elongate backrest support members 12, and also including leg members 13,14 being conventionally attached to the elongate seat support members 11 and to the elongate backrest support members 12. The elongate backrest support members 12 are spaced apart and extend upwardly from the elongate seat support members 11. The leg members 13,14 include front leg members 13 depending downwardly from front ends of the elongate seat support members 11, and also includes rear leg members 14 which are integral extensions of the elongate backrest support members 12. Angled armrest members 35 are securely and conventionally attached to the elongate seat support members 11 and to the elongate backrest support members 12 with arm cushions 36 being conventionally attached to the angled armrest members 35.

A wheel assembly is conventionally mounted to the leg members 13,14. The wheel assembly includes front wheel members 15 which are journaled at bottom ends of the front leg members 13, and also includes rear wheel members 16 which are journaled at bottom ends of the rear leg members 14. Handle members 17 are conventionally attached to the elongate backrest support members 12. The handle members 17 are curved integral extensions from top ends of the elongate backrest support members 12.

A seat assembly is conventionally disposed upon the elongate seat support members 11. The seat assembly includes a base seat cushion 18 which is securely and conventionally disposed upon the elongate seat support members 11 and which has an opening 19 being disposed therethrough, and also includes a seat cushion insert 20 being removably disposed in the opening 19 of the base seat cushion 18, and further includes a pair of laterally-angled rail members 25,28 being spaced apart and being securely and conventionally attached to the frame assembly beneath the base seat cushion 18 and extending from a front to a back of the base seat cushion 18, and also includes a seat cushion support member 37 being slidably disposed upon the pair of laterally-angled rail members 25,28 and having a handhold 38 being conventionally attached thereto for securely retaining the seat cushion insert 20 in the opening 19 of the base seat cushion 18. Each of the laterally-angled rail members 25,28 includes a first longitudinal side portion 26,29 having a longitudinal edge which is securely and conventionally attached to the frame assembly, and also includes a second longitudinal side portion 27,30 which is angled approximately 90 degrees from the first longitudinal side portion 26,29.

As a first embodiment, the seat assembly further includes a hinge member 21 being securely and conventionally attached and bolted to a bottom side of the base seat cushion 18, and also includes a support door member 22 being securely and conventionally attached to the hinge member 21 and being closable over the opening 19 through the base seat cushion 18 and also having a handle 23 being securely and conventionally attached thereto. The seat cushion insert 20 has a thickness generally equivalent to the base seat cushion 18 and is securely and conventionally attached to the support door member 22.

As a second embodiment, the seat assembly also includes a fulcrum 39 being securely and conventionally attached to the frame assembly beneath the base seat cushion 18; and further includes a lever 40 being pivotally mounted upon the fulcrum 39, and having an arcuate intermediate portion 41 which receives the fulcrum 39, and also having an angled end portion 42 for engaging and urging the seat cushion insert 20 from the opening 19 of the base seat cushion 18, and also having a handle portion 43, and further having a planar lift member 44 being conventionally attached to an end of the end portion 42 of the lever 40 for lifting the seat cushion insert 20 from out of the opening 19 of the base seat cushion 18; and also includes a hook assembly having a sleeve portion 45 which is conventionally attached about the handle portion 43 and also having a hook portion 46 for keeping the seat cushion insert 20 out of the opening of the base seat cushion 18; and further includes a hook support member 47 being conventionally attached to the frame assembly and to which the hook portion 46 is attachable. A backrest member 24 is conventionally supported by the backrest support members 12.

A commode assembly includes a receptacle 31 being removably supported by the pair of laterally-angled rail members 25,28. The receptacle 31 includes bottom and side walls 32,33, and also includes an open top, and further includes a lip 34 integrally extending along a top edge of the side walls 33 and extending outwardly and being slidably disposed on the laterally-angled rail members.

In use, the user would sit upon the base seat cushion 18 just like a conventional wheelchair. However, instead of the user having to be removed to a toilet seat, the seat cushion support member can be removed and the support door member 22 can be hingedly opened and the receptacle 31 can be disposed under the opening 19 so that the user can go to the toilet while be seated upon one's wheelchair.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the commode convertible wheelchair apparatus. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A commode convertible wheelchair apparatus comprising:

a frame assembly including elongate seat support members and elongate backrest support members, and also including leg members being attached to said elongate seat support members and to said elongate backrest support members;

a wheel assembly being mounted to said leg members;

handle members being attached to said elongate backrest support members;

a seat assembly being disposed upon said elongate seat support members, said seat assembly includes including a base seat cushion which is securely disposed upon said elongate seat support members and which has an opening disposed therethrough, and also includes including a seat cushion insert being removably disposed in said opening of said base seat cushion, and further includes including a pair of laterally-angled rail members being spaced apart and being securely attached to said frame assembly beneath said base seat cushion and extending from a front to a back of said base seat cushion, and also includes including a seat cushion support member being slidably disposed upon said pair of laterally-angled rail members and having a handhold being attached thereto for securely retaining said seat cushion insert in said opening of said base seat cushions;

a backrest member being supported by said backrest support members; and a commode assembly including a receptacle being removably supported by said seat assembly.

2. A commode convertible wheelchair apparatus as described in claim 1, wherein said pair of laterally-angled rail members are spaced apart and are securely attached to said frame assembly beneath said base seat cushion and extending from a front to a back of said base seat cushion.

3. A commode convertible wheelchair apparatus as described in claim 2, wherein each of said laterally-angled rail members includes a first longitudinal side portion having a longitudinal edge which is securely attached to said frame assembly, and also includes a second longitudinal side portion which is angled approximately 90 degrees from said first longitudinal side portion and upon which said lip is slidably disposed.

4. A commode convertible wheelchair apparatus as described in claim 3, wherein said seat assembly further includes a hinge member being securely attached to a bottom side of said base seat cushion, and also includes a support door member being securely attached to said hinge member and being closable over said opening through said base seat cushion and also having a handle securely attached thereto.

5. A commode convertible wheelchair apparatus as described in claim 4, wherein said seat cushion insert has a thickness generally equivalent to said base seat cushion, and is securely attached to said support door member.

6. A commode convertible wheelchair apparatus as described in claim 3, the seat assembly also includes a fulcrum being securely attached to said frame assembly beneath said base seat cushion; and further includes a lever being pivotally mounted upon said fulcrum.

7. A commode convertible wheelchair apparatus as described in claim 6, wherein said lever has an arcuate intermediate portion which receives said fulcrum, and also has an angled end portion for engaging and urging said seat cushion insert from said opening of said base seat cushion, and also has a handle portion, and further has a planar lift member being conventionally attached to an end of said end portion of said lever for lifting said seat cushion insert from out of said opening of said base seat cushion; said seat assembly also including a hook assembly having a sleeve portion which is attached about said handle portion and also having a hook portion for keeping said seat cushion insert out of said opening of said base seat cushion, and further including a hook support member being attached to said frame assembly and to which said hook portion is attachable.

8. A commode convertible wheelchair apparatus as described in claim 4, wherein said receptacle includes a bottom and side walls, and also includes an open top, and further includes a lip extending along a top edge of said side walls and extending outwardly and being slidably disposed on said laterally-angled rail members.

* * * * *